US006946900B2

(12) United States Patent
Inoue

(10) Patent No.: US 6,946,900 B2
(45) Date of Patent: Sep. 20, 2005

(54) CURRENT OUTPUT CIRCUIT

(75) Inventor: Hidekazu Inoue, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/741,037

(22) Filed: Dec. 19, 2003

(65) Prior Publication Data

US 2004/0145409 A1 Jul. 29, 2004

(30) Foreign Application Priority Data

Dec. 27, 2002 (JP) ..... 2002-381412

(51) Int. Cl.[7] ..... G05F 1/10; G05F 3/02
(52) U.S. Cl. ..... 327/543; 323/315
(58) Field of Search ..... 327/538, 543; 323/315

(56) References Cited

U.S. PATENT DOCUMENTS 4,727,309 A * 2/1988 Vajdic et al. ..... 323/315
5,455,522 A * 10/1995 Jones ..... 326/27
5,579,356 A * 11/1996 Chevallier ..... 377/20
5,675,242 A * 10/1997 Nakano ..... 323/312

FOREIGN PATENT DOCUMENTS

JP 2002-261243 9/2002

* cited by examiner

*Primary Examiner*—Quan Tra
(74) *Attorney, Agent, or Firm*—Hogan & Hartson, LLP

(57) ABSTRACT

Breakdown of a zapping diode is attained through zapping, and causes a switching transistor to be switched off. The switching transistor is connected in parallel with a current-determining transistor for inducing flow of a constant current and which is diode-connected. When the switching transistor is switched off, a current flows through the current-determining transistor. An adjustment current identical with the current flowing through the current-determining transistor flows through an adjustment current transistor which is connected to the current-determining transistor to form a current mirror. When, on the other hand, no zapping is performed, the switching transistor is switched on and the current-determining transistor is switched off, causing no current to flow through the adjustment current transistor. In this manner, with the current-determining transistor being diode-connected, Vce is a constant value, and the ON-resistance does not affect the magnitude of the adjustment current, enabling attainment of a stable adjustment current.

3 Claims, 2 Drawing Sheets

CURRENT OUTPUT CIRCUIT

BACKGROUND OF THE INVENTION

1. Field of the Invention

The present invention relates to a current output circuit in which an amount of current is adjusted through zapping.

2. Description of the Related Art

In many cases, the manufacture of various circuits requires a final adjustment process. In particular, in semiconductor integrated circuits or the like, variations among elements cannot be completely eliminated, and thus, a product requires adjustment of characteristics after the completion of manufacture.

Various methods are employed for this final adjustment, including adjustment of an amount of current within an internal circuit through zapping. In this zapping process, for example, a zapping terminal to which a zapping diode is connected is provided and a predetermined voltage is applied to the zapping terminal to induce breakdown of the zapping diode. Provision of a transistor which is switched on and off by the zapping diode enables adjustment of an amount of current of a constant current source or the like within an internal circuit.

A zapping circuit described above is embodied by various circuits, including a structure disclosed in Japanese Patent Laid-Open Publication No. 2002-261243.

In many transistors which are switched on and off through zapping, an amount of current flowing through the transistor when the transistor is switched on is an adjustment current that is added to or reduced from a reference current. For example, in the above-identified Japanese Patent Laid-Open Publication No. 2002-261243, ON/OFF states of a plurality of adjustment current transistors are controlled in order to control the overall amount of current. Therefore, the amount of current flowing through the adjustment current transistor when the transistor is ON is an important parameter.

In conventional devices, the transistor for inducing flow of the adjustment current is generally connected in series to a resistance, and the magnitude of the adjustment current flowing through the transistor is set by the magnitude of the resistance. However, because the adjustment current transistor is generally switched fully on, Vce becomes small and the transistor becomes saturated. Therefore, the magnitude of the adjustment current is affected not only by the resistance of the resistor, but also by the ON-resistance (emitter resistance) of the adjustment current transistor. The ON-resistances of saturated transistors are significantly affected by variations among transistors, raising a problem that the adjustment currents vary. In addition, the ON-resistance of a transistor has temperature characteristics, and compensation of these characteristics has been difficult.

SUMMARY OF THE INVENTION

According to one aspect of the present invention, a transistor for determining the magnitude of current (hereinafter called a "current-determining transistor") is diode-connected. Therefore, when current flows through the current-determining transistor, the voltage drop at the transistor is Vbe. Therefore, a constant current can flow stably without dependence on the ON-resistance of the transistor.

According to another aspect of the present invention, the temperature characteristics of the current-determining transistor can be easily compensated by inserting a diode in a reference power supply for supplying a reference voltage.

DESCRIPTION OF PREFERRED EMBODIMENTS

Preferred embodiments of the present invention (hereinafter may be referred to as simply "embodiments") will now be described with reference to the drawings.

Figure 1:
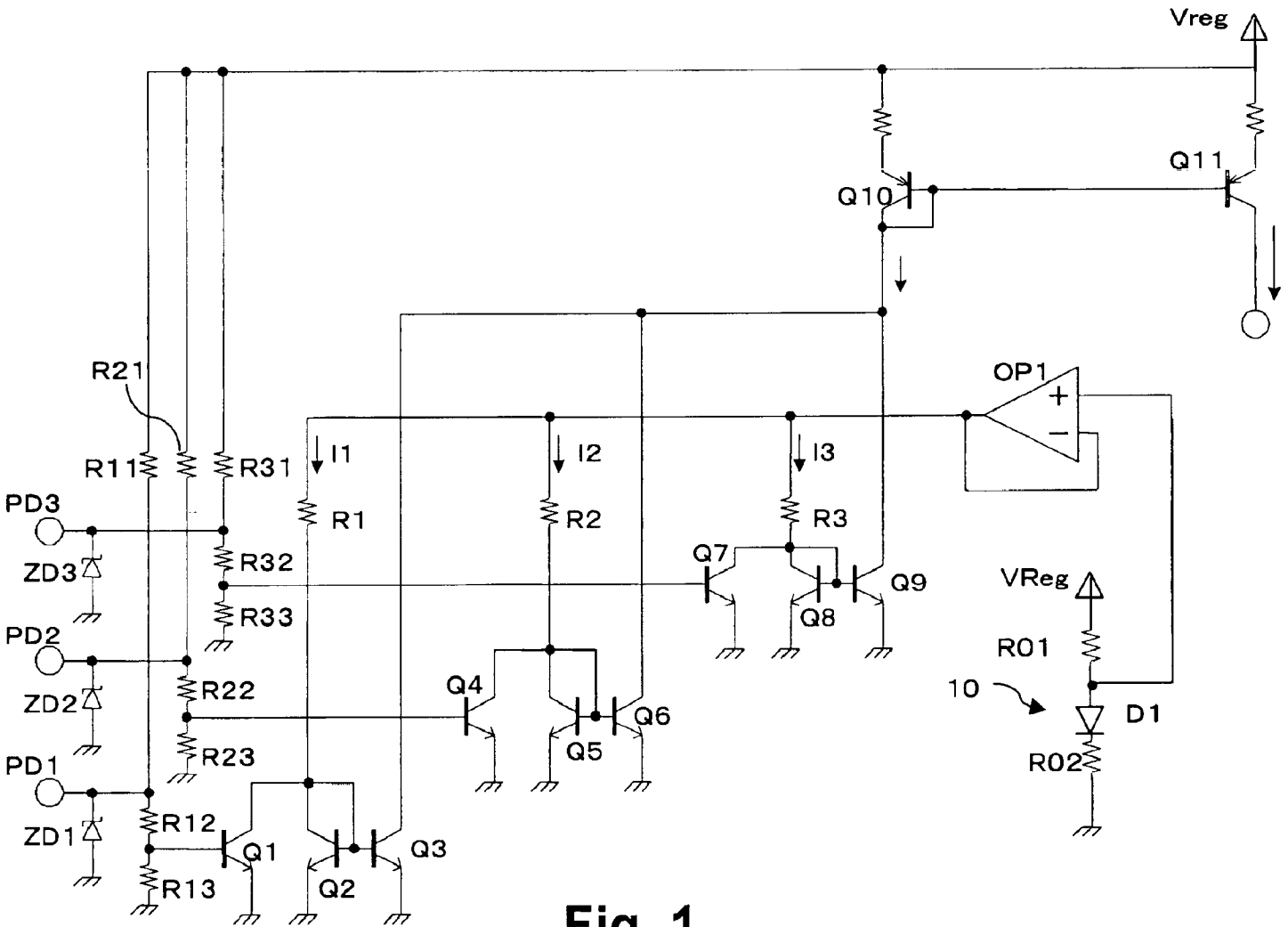
FIG. 1 is a diagram showing a circuit according to a preferred embodiment of the present invention.

FIG. 1 is a circuit diagram showing a structure of a preferred embodiment of the present invention.

In the present specification, the words "zapping diode" mean "Zener diode for use of zapping." A resistance of a zapping diode (=Zener diode) becomes 0 by zapping and function of the Zener diode will not be recovered.

A reference power supply 10 is a circuit which outputs a reference voltage. In the preferred embodiment, the reference power supply 10 comprises a serially connected structure consisting of a resistor R01, a diode D1, and a resistor R02, arranged between a predetermined power supply Vreg and the ground. A voltage at the upper side (anode side) of the diode D1 is determined from the voltage of the power supply Vreg, a voltage drop at the diode D1 (1Vbe), and resistance values of the resistors R01 and R02. The determined anode-side voltage is output as a reference voltage. Therefore, the temperature characteristics of 1Vbe at the diode D1 are imparted to the reference voltage.

The reference voltage is input to a positive input terminal of an operational amplifier OP1. This operational amplifier OP1 is a buffer amplifier in which an output terminal is connected (or short-circuited) to a negative input terminal. Therefore, a reference voltage is stably output on the output of the operational amplifier OP1.

Collectors of two NPN-type transistors Q1 and Q2 each having an emitter connected to the ground are connected to the output of the operational amplifier OP1 via a resistor R1. A base and a collector of transistor Q2 are connected (diode connection) to each other, and a base of an NPN-type transistor Q3 having an emitter connected to the ground is connected to the base of the transistor Q2. Therefore, the transistors Q2 and Q3 form a current mirror. An adjustment current I1 having a magnitude of a voltage which is reduced by 1Vbe from the reference voltage divided by the resistance of the resistor R1 flows through the transistor Q2, and a current having the same magnitude flows through the transistor Q3.

In the illustrated structure, two circuits having the same structure as the circuit comprising the resistor R1 and the transistors Q1, Q2, and Q3 are additionally provided on the output of the operational amplifier OP1. That is, a circuit comprising a resistor R2 and transistors Q4, Q5, and Q6, and a circuit comprising a resistor R3 and transistors Q7, Q8, and Q9 are provided. Similar to the case of the first circuit, an adjustment current I2 which is determined by the resistor R2 flows through the transistor Q6, and an adjustment current I3 which is determined by the resistor R3 flows through the transistor Q9.

The collectors of the transistors Q3, Q6, and Q9 are commonly connected to a collector of a PNP-type transistor Q10, which has an emitter connected to the power supply Vreg via a resistance, and a base and a collector which are mutually connected. Therefore, a current which is obtained by adding the adjustment currents flowing through the transistors Q3, Q6, and Q9 flows through the transistor Q10. A base of a PNP-type transistor Q11 which has an emitter connected to the power supply Vreg via a resistor is connected to a base of the transistor Q10. A collector of the transistor Q11 constitutes a current output terminal.

Thus, the transistors Q10 and Q11 form a current mirror, and a reference current identical with a reference current flowing through the reference transistor, the transistor Q10, flows through the transistor Q11 and is output. Provision of a plurality of transistors which are connected to the transistor Q10 to form current mirrors enables these transistors to also output reference currents. By changing the area of the emitter of the output transistor, the magnitude of the current to be output can be changed to various different values.

A connection point between resistors R12 and R13 among three serially connected resistors R11, R12, and R13 connected between the power supply Vreg and the ground is connected to the base of the transistor Q1. The resistance values of the resistors R11, R12, and R13 are set so that the voltage of the connection point between the resistors R12 and R13 is sufficient to allow the transistor Q1 to be switched on. In addition, a cathode of a zapping diode ZD1 having an anode connected to the ground and a zapping terminal PD1 are connected to a connection point between the resistors R11 and R12 among the three serially connected resistors R11, R12, and R13.

Similarly, circuits identical with that connected to the base of the transistor Q1 are respectively connected to the bases of the transistors Q4 and Q7. That is, a resistance divider circuit comprising resistors R21, R22, and R23, and a zapping diode ZD2 and a zapping terminal PD2 which are connected to the resistance divider circuit are connected to the base of the transistor Q4, and a resistance divider circuit comprising resistors R31, R32, and R33, and a zapping diode ZD3 and a zapping terminal PD3 which are connected to the resistance divider circuit are connected to the base of the transistor Q7.

Before zapping by the zapping terminals PD1, PD2, and PD3 occurs, the zapping diodes (Zener diode) ZD1, ZD2, and ZD3 are functioning and the voltage on the cathode side is maintained. Thus, the transistors Q1, Q4, and Q7 are in an ON state. These transistors Q1, Q4, and Q7 are configured such that when these transistors are ON, current flows through these transistors in place of the transistors Q2, Q5, and Q8, and no current flows through the transistors Q2, Q5, and Q8. Therefore, no current flows through the transistors Q2, Q3, Q5, Q6, Q8, and Q9, and adjustment currents become I1=I2=I3=0. Thus, total adjustment current is 0 and no current flows through the transistors Q10 and Q11. Therefore, the output current from the zapping circuit is 0.

In this circuit, by individually applying, to the zapping terminals PD1, PD2, and PD3, a voltage which is sufficient for the zapping diodes ZD1, ZD2, and ZD3 to attain destructive breakdown (break), the zapping diodes ZD1, ZD2, and ZD3 can attain break independently. When the zapping diode ZD1, ZD2, or ZD3 is broken, the zapping terminal PD1, PD2, or PD3 is connected to the ground.

For example, when a predetermined voltage is applied to the zapping terminal PD1 to induce break of the zapping diode ZD1, the base of the transistor Q1 is connected to the ground and the transistor Q1 is switched off. When the transistor Q1 is switched off, adjustment current I1 flows through the transistor Q2, causing the adjustment current I1 to also flow through the transistors Q3, Q10, and Q11.

Similarly, when zapping is performed by the zapping terminal PD2, the adjustment current 12 flows through the transistors Q5, Q6, Q10, and Q11, and when zapping is performed by the zapping terminal PD3, the adjustment current 13 flows through the transistors Q8, Q9, Q10, and Q11. Therefore, through zapping, the current in the transistor Q11 can be set to 8 different values: 0, I1, I2, I3, I1+I2, I2+I3, I3+I1, and I1+I2+I3. By setting, for example, the adjustment currents I1, 12, and I3 at a ratio of 1:2:4, 8 different currents from 0 to 7 can be obtained.

By changing an emitter area ratio in each of pairs of transistors (Q1, Q2), (Q4, Q5), and (Q7, Q8) forming a current mirror, the adjustment currents I1, I2, and I3 can be changed independently. In addition, by changing the resistance values of the resistors R1, R2, and R3, the adjustment currents I1, 12, and 13 can be changed independently.

In this configuration, when the transistor Q1, Q4, or Q7 is ON, no corresponding adjustment current flows. Therefore, the adjustment current can be set without consideration of the ON-resistances of these transistors Q1, Q4, and Q7. On the other hand, when the transistor Q1, Q4, or Q7 is OFF, current flows through the transistor Q2, Q5, or Q8. However, as described above, in each of the transistors Q2, Q5, and Q8, the collector and base are mutually connected, and, thus, the voltage drop is constant, at 1Vbe. Therefore, the adjustment currents I1, I2, and I3 when zapping is performed depend respectively on resistors R1, R2, and R3, but do not depend on the ON-resistances of the transistors Q2, Q5, and Q8. The adjustment currents I1, I2, and I3 are therefore less affected by variations in the transistors. In addition, although the adjustment currents I1, I2, and I3 are affected respectively by the temperature characteristics of Vbe of the transistors Q1, Q4, and Q7, the reference voltage from the reference power supply 10 is also affected by the temperature characteristics of Vbe of the diode D1, in such a manner that the temperature characteristics are cancelled out. Therefore, the present embodiment has an advantage in that the adjustment currents I1, I2, and I3 are basically unaffected by the temperature characteristics of transistors.

Figure 2:
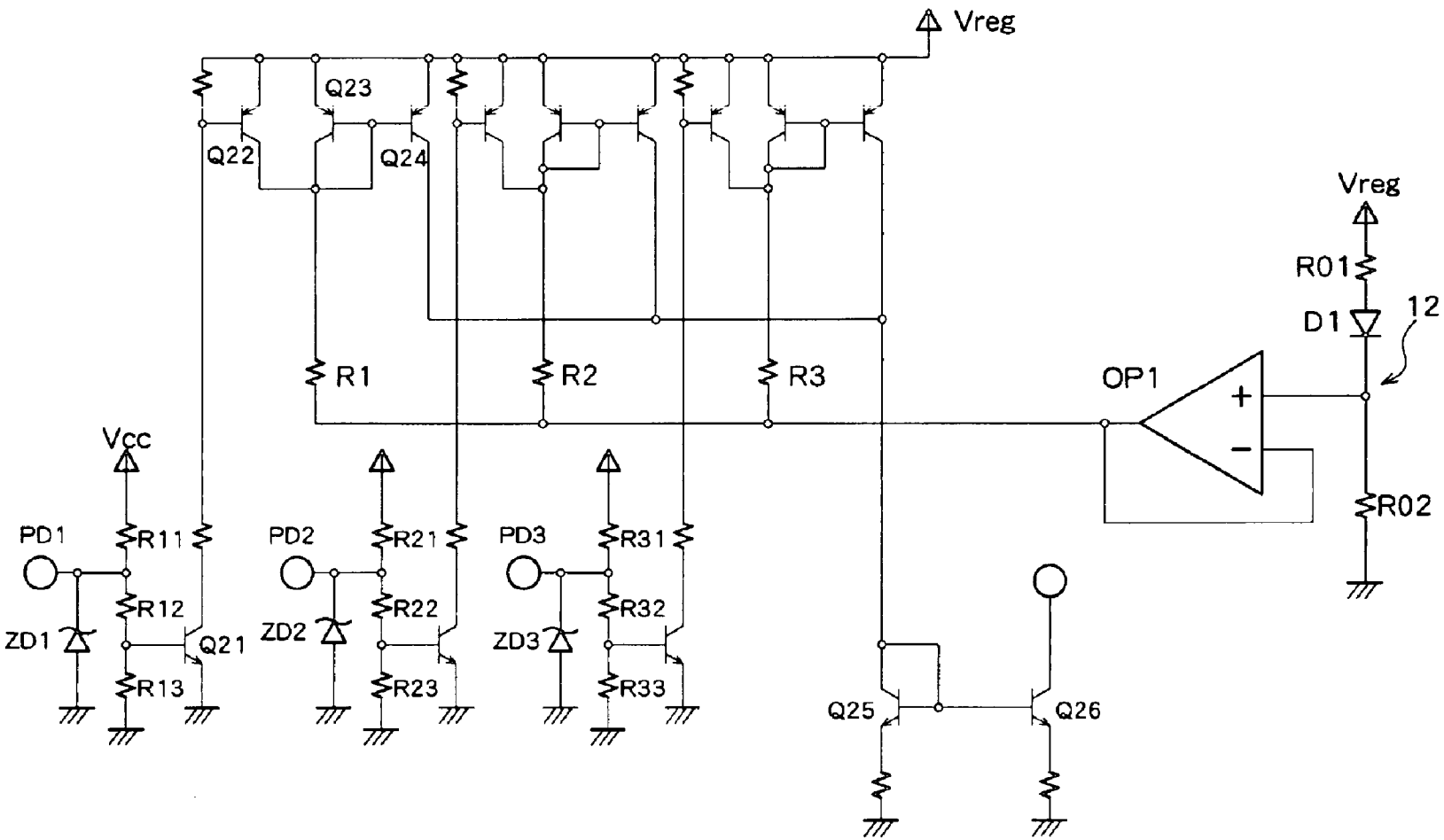
FIG. 2 is a diagram showing a circuit according to another preferred embodiment of the present invention.

In the above-described embodiment, the transistors for adjustment current, Q2, Q3, Q5, Q6, Q8, and Q9, are described as being NPN transistors. However, PNP transistors can be employed in place of the NPN transistors. FIG. 2 shows an example circuit structure in this case.

The structures of zapping terminals PD1, PD2, and PD3, zapping diodes ZD1, ZD2, and ZD3 connected to the zapping terminals, and resistors R11, R12, R13, R21, R22, R23, R31, R32, and R33 are identical with those in the above-described case. The circuits for switching on and off three adjustment currents are identical with each other, and thus, only one of these circuits will be described.

A connection point between the resistors R12 and R13 is connected to a base of an NPN-type transistor Q21. An emitter of the transistor Q21 is connected to the ground, and a collector of the transistor Q21 is connected to a power supply Vreg via two resistors. A connection point between the two resistors is connected to a base of a PNP-type transistor Q22. An emitter of the transistor Q22 is connected to the power supply Vreg, and a collector of the transistor Q22 is connected to a collector of a PNP-type transistor Q23, which has an emitter connected to the power supply Vreg. The collector and a base of the transistor Q23 are mutually connected, and the base of the transistor Q23 is connected to a base of a transistor Q24. An emitter of the transistor Q24 is connected to the power supply Vreg, and the transistors Q23 and Q24 form a current mirror.

An output of an operational amplifier OP1 having its output terminal and its negative input terminal mutually connected is connected to the collectors of the transistors Q22 and Q23 via a resistor R1. A reference power supply 12 is connected to a positive input terminal of the operational amplifier OP1. The reference power supply 12 is similar to the reference power supply 10, in that the reference power supply 12 comprises a serial connection consisting of a resistor R01, a diode D1, and a resistor R02 between the power supply Vreg and the ground. The reference power supply 12 differs from the reference power supply 10 in that the cathode (lower side) of the diode D1 is connected to the positive input terminal of the operational amplifier OP1.

A collector of the transistor Q24 is connected to a collector of an NPN-type transistor Q25, which has its emitter connected to the ground and its collector and base mutually connected. A base of a transistor Q26 having its emitter connected to the ground is connected to the base of the transistor Q25.

As illustrated in FIG. 4, resistors are preferably inserted between emitters of transistors Q25 and Q26 and the ground.

Therefore, when zapping is not performed, the transistor Q21 is switched on and the transistor Q22 is switched on, causing the transistors Q23 and Q24 to be switched off, and no adjustment current flows. When, on the other hand, zapping is performed, the transistor Q21 is switched off and the transistor Q22 is switched off, causing the transistors Q23 and Q24 to be switched on and the adjustment current to flow. In this structure also, when the transistor Q23 is ON, Vce is fixed to Vce=Vbe, and thus, this circuit is not affected by the ON-resistance of the transistor Q23. The temperature characteristics of the transistor Q22 are compensated by the temperature characteristics of the diode D1.

In this manner, in this circuit, adjustment current having a stable current value can be adjusted. A current adjusted by zapping can be used in various circuits. For example, the adjusted current maybe used as a current for adjusting a center frequency in a band-pass filter.

What is claimed is:

1. A current output circuit in which a current can be adusted through zapping, the circuit comprising:

a reference transistor for inducing flow of a reference current for determining a current of a constant current source;

an adjustment current transistor for inducing flow of an adjustment current which constitutes at least a portion of the reference current flowing through the reference transistor;

a current-determining transistor, which forms a current mirror in combination with the adjustment current transistor, for determining an adjustment current flowing through the adjustment current transistor, the current-determining transistor being diode-connected; and a switching transistor, which is connected in parallel with the current-determining transistor, current flowing through the switching transistor and not through the current-determining transistor when the switching transistor is switched on, and current flowing through the current-determining transistor when the switching transistor is switched off, wherein the switching transistor is set to be on or off through a zapping operation with respect to a zapping terminal, the reference current is adusted by the on/off state of the switching transistor, a reference voltage is applied to the current-determining transistor via a resistor, the reference voltage is generated from a reference power supply, and the reference power supply includes a compensation transistor which is diode-connected, the compensation transistor in the reference power supply is inserted at an intermediate point of voltage divider resistors, and temperature characteristics of the current-determining transistor are compensated by a voltage change of the reference voltage stemming from temperature characteristics of the compensation transistor.

2. The current output circuit according to claim 1, wherein a zapping diode is connected to the zapping terminal, and breakdown of the zapping diode is attained by a zapping operation in which a predetermined high voltage is applied to the zapping terminal.

3. The current output circuit according to claim 1, wherein voltage divider resistors are connected to the zapping terminal, and the on/off state of the switching transistor is controlled by a voltage at an intermediate point of the voltage divider resistors.

* * * * *